US011784012B2

(12) United States Patent
Fan

(10) Patent No.: US 11,784,012 B2
(45) Date of Patent: Oct. 10, 2023

(54) ELECTRONIC DEVICE

(71) Applicant: GUANGDONG OPPO MOBILE TELECOMMUNICATIONS CORP., LTD., Guangdong (CN)

(72) Inventor: Wei Fan, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 0 days.

(21) Appl. No.: 17/183,935

(22) Filed: Feb. 24, 2021

(65) Prior Publication Data

US 2021/0265118 A1 Aug. 26, 2021

(30) Foreign Application Priority Data

Feb. 26, 2020 (CN) ..... 202020215579.4

(51) Int. Cl.
*H01H 13/14* (2006.01)
*H01H 13/26* (2006.01)

(52) U.S. Cl.
CPC ..... *H01H 13/14* (2013.01); *H01H 13/26* (2013.01); *H01H 2231/022* (2013.01)

(58) Field of Classification Search
CPC .. H01H 13/14; H01H 13/26; H01H 2231/022; H01H 2300/016; H01H 13/70; H01H 2221/03; H01H 2221/044; H01H 2221/058; H01H 2221/064; H01H 13/06
See application file for complete search history.

(56) References Cited

U.S. PATENT DOCUMENTS

| | | | | |
|---|---|---|---|---|
| 9,952,558 | B2 * | 4/2018 | Ely | H01H 25/06 |
| 10,037,006 | B2 * | 7/2018 | Ely | G04G 21/00 |
| 10,437,289 | B2 * | 10/2019 | Chang | H01H 13/06 |
| 10,845,764 | B2 * | 11/2020 | Ely | G04B 37/106 |
| 2012/0061222 | A1 | 3/2012 | Dai | |
| 2015/0348724 | A1 | 12/2015 | Yeh et al. | |

FOREIGN PATENT DOCUMENTS

| | | |
|---|---|---|
| CN | 208014588 | 10/2018 |
| EP | 1422733 | 5/2004 |
| EP | 3598723 | 1/2020 |

OTHER PUBLICATIONS

EPO, Extended European Search Report for EP Application No. 21159503.8, dated Jun. 30, 2021.
IPI, Office Action for IN Application No. 202114007928, dated Jan. 24, 2022.

* cited by examiner

*Primary Examiner* — Lheiren Mae A Caroc
(74) *Attorney, Agent, or Firm* — Hodgson Russ LLP

(57) ABSTRACT

An electronic device is provided. The electronic device includes a frame, a signal trigger fixed inside the frame, and a button penetrating the frame. The button includes a button post, an elastic cushion, and a button cap. The button post penetrates the frame to be adjacent to the signal trigger. The elastic cushion is fixed to an end of the button post away from the signal trigger. The button cap is fixedly connected to a side of the elastic cushion away from the button post. The elastic cushion is connected between the button post and the button cap, and the button cap can move relative to the button post due to elastic deformation of the elastic cushion.

20 Claims, 12 Drawing Sheets

ELECTRONIC DEVICE

CROSS-REFERENCE TO RELATED APPLICATION(S)

This disclosure claims priority to Chinese Patent Application No. 202020215579.4, filed on Feb. 26, 2020, the entire disclosure of which is hereby incorporated by reference.

TECHNICAL FIELD

The present disclosure relates to the field of communication devices, and particularly to an electronic device.

BACKGROUND

Generally, electronic devices are provided with buttons, such that the electronic devices can be controlled and operated through the buttons. However, since the button has a large length between two ends, one end of the button is prone to be lifted up and the other end is stuck accordingly when the button is pressed, resulting in failure in automatic reset of the button and poor operation performance.

SUMMARY

An electronic device is provided. The electronic device includes a frame, a signal trigger fixed inside the frame, and a button penetrating the frame. The button includes a button post, an elastic cushion, and a button cap. The button post penetrates the frame to be adjacent to the signal trigger. The elastic cushion is fixed to an end of the button post away from the signal trigger. The button cap is fixedly connected to a side of the elastic cushion away from the button post.

In the electronic device according to implementations of the present disclosure, the elastic cushion is connected between the button post and the button cap, and the button cap can move relative to the button post due to elastic deformation of the elastic cushion, in this way, one end of the button is avoided from being stuck even when the other end of the button is lifted up, as such, failure of the button is avoided, effective operation performance of the button is ensured, and the service life of the button is prolonged.

BRIEF DESCRIPTION OF THE DRAWINGS

To describe the technical solutions in the implementations of the present disclosure more clearly, the following briefly introduces the accompanying drawings required for describing the implementations. Apparently, the accompanying drawings in the following description illustrate some implementations of the present disclosure. Those of ordinary skill in the art may also obtain other drawings based on these accompanying drawings without creative efforts.

DETAILED DESCRIPTION OF ILLUSTRATED IMPLEMENTATIONS

Technical solutions in the implementations of the present disclosure will be described clearly and completely hereinafter with reference to the accompanying drawings.

Figure 1:
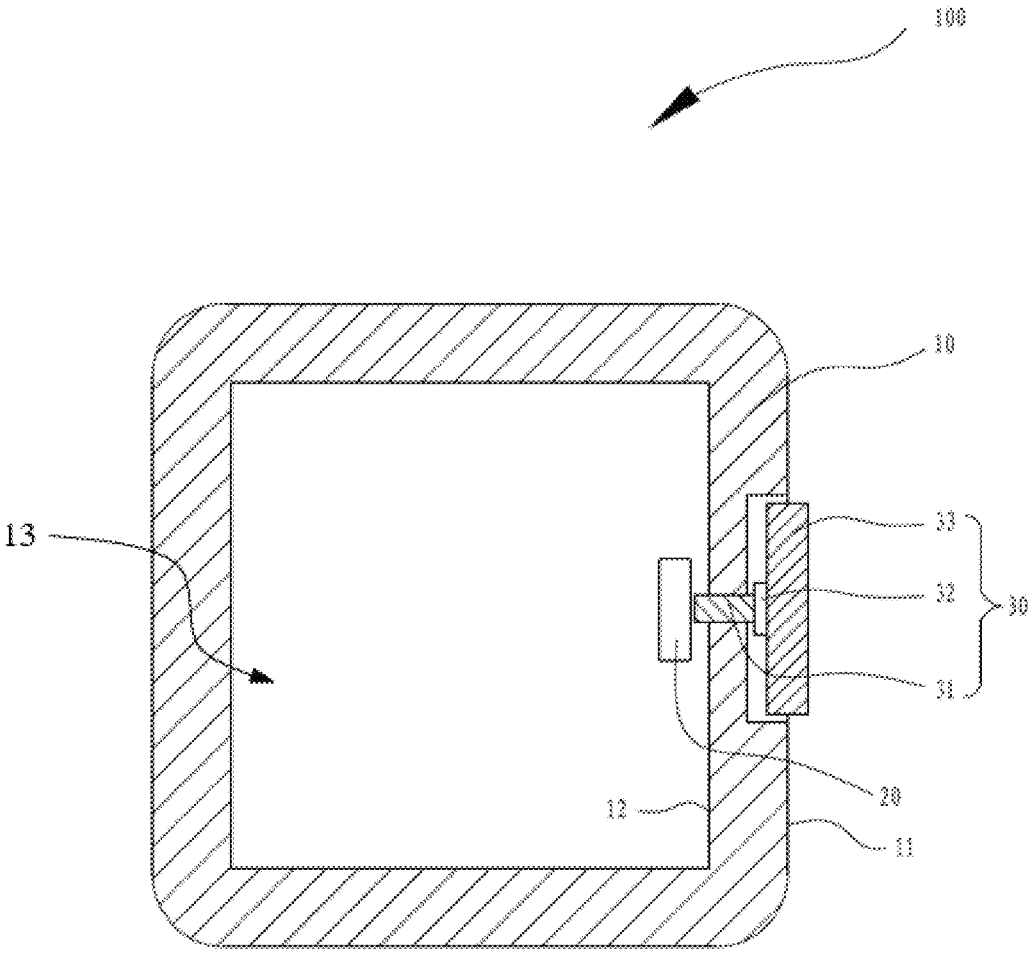
FIG. 1 is a schematic cross-sectional view of an electronic device according to implementations of the present disclosure.
Figure 2:
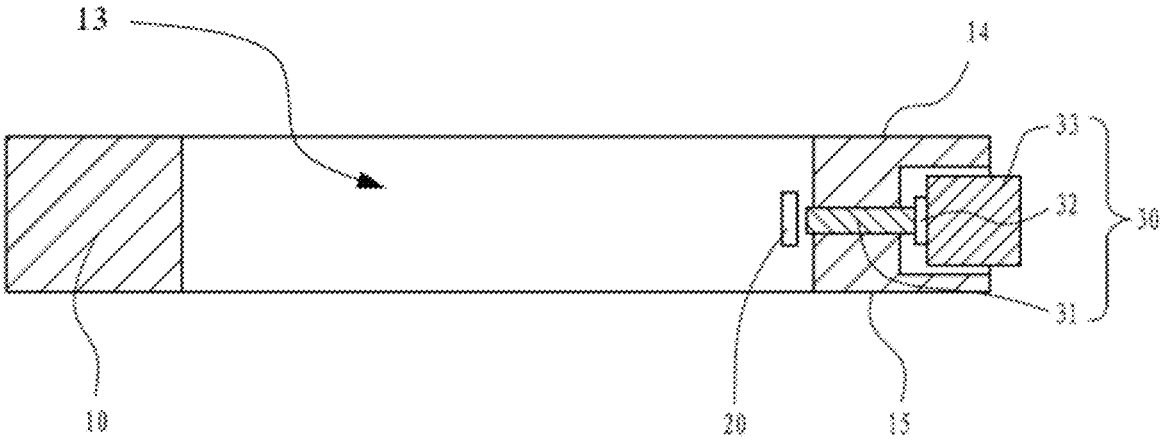
FIG. 2 is a schematic partial cross-sectional view of the electronic device according to implementations of the present disclosure.
Figure 3:
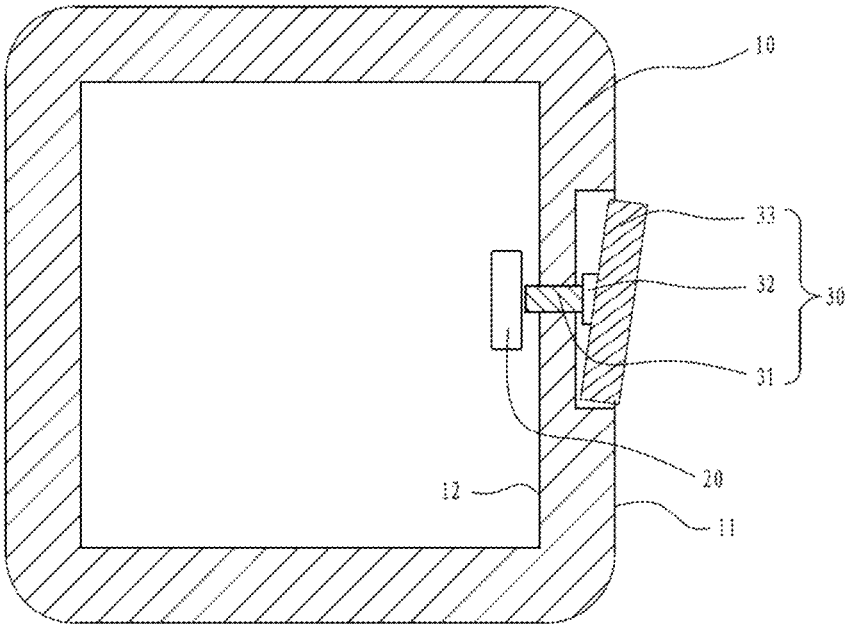
FIG. 3 is a schematic cross-sectional view of the electronic device according to implementations of the present disclosure.

Referring to FIGS. 1 to 3, an electronic device 100 is provided. The electronic device 100 includes a frame 10, a signal trigger 20 fixed inside the frame 10, and a button 30 penetrating the frame 10. The button 30 includes a button post 31, an elastic cushion 32, and a button cap 33. The button post 31 penetrates the frame 10 to be abutted against (or, in contact with) the signal trigger 20. The elastic cushion 32 is fixed to an end of the button post 31 away from the signal trigger 20. The button cap 33 is fixedly connected to a surface of the elastic cushion 32 away from the button post 31.

The electronic device 100 may be a terminal device such as a mobile phone, a tablet computer, a notebook computer, etc. Alternatively, the electronic device 100 may be a smart wearable device such as a smart watch, a smart earphone, smart glasses, etc. When being pressed, the button cap 33 transfers a pressure force to the button post 31 via the elastic cushion 32, such that the button post 31 triggers the signal trigger 20 to transmit a signal, to realize control of the electronic device 100.

In conventional technical solutions, the button cap 33 and the button post 31 of the button 30 are formed integrally, or are firmly fixed together by other means. Generally, the button cap 33 has a relative large length between two ends. When pressing one end of the button cap 33, the other end will be lifted up. The electronic device 100 is provided with a guide structure for guiding sliding of the button post 31. When the button cap 33 is tilted up, it is easy to cause the button post 31 and the guide structure to be non-coaxial and in turn cause the button 30 to be stuck. It is noted that, when the button post 31 is non-coaxial with the guide structure (for example, the pressure force applied on button cap 33 will be transferred to the button post 31 and in turn cause the button post 31 to be inclined relative to the guide structure), the button post 31 may be stuck by the guide structure (for example, a guide hole). Therefore, the button 30 and the button cap 33 are designed to form separately, and the button cap 33 is movably connected with the button post 31, which is beneficial to allowing the button cap 33 to withstand various pressing forces in different forms. As such, even if the button cap 33 is tilted up, the button post 31 remains coaxial with the guide structure, and the availability of the button 30 is ensured. In an implementation, the guide structure is a through hole.

In implementations of the present disclosure, the elastic cushion 32 is connected between the button cap 33 and the button post 31, the elastic deformation performance of the elastic cushion 32 allows the button cap 33 to move relative to the button post 31, such that the button post 31 is prevented from being stuck due to tilt-up of the button post 31, failure of the button 30 can be prevented, the effective pressing performance of the button 30 can be ensured, and the service life of the button 30 can be prolonged.

In this implementation, the frame 10 serves as a framework of the electronic device 100 to carry various components of the electronic device 100, such that the electronic device 100 is stable in the overall structure. Due to rigidity and stresses, the frame 10 provides the electronic device 100 with protective performance such as safety, drop resistance, shatter resistance, and crack resistance. The frame 10 can be closely fit with some structures of the electronic device 100 to achieve dustproof, waterproof, fireproof, and other protective performance.

In an implementation, the frame 10 has an outer side surface 11 and an inner side surface 12 opposite to the outer side surface 11. The inner side surface 12 may be a combination of flat surfaces and non-flat surfaces. That is, the inner side surface 12 of the frame 10 may have multiple depressions and multiple protrusions in such a way that the inner side surface 11 of the frame 10 can match and secure various components. The inner side surface 12 is an interface of the frame 10, and can substantially enclose to define an inner space. The outer side surface 11 may be a combination of flat surfaces and non-flat surfaces. That is, the outer side surface 11 may also have multiple depressions and multiple protrusions. The outer side surface 11 substantially forms the appearance surface of the frame 10. The inner side surface 12 encloses to form an accommodating space 13. The accommodating space 13 is used for accommodating various functional components such as a mainboard, a signal trigger, a camera, a sensor, a memory, an antenna, and the like.

The frame 10 further has a first end surface 14 and a second end surface 15 opposite to the first end surface 14. The inner side surface 12 and the outer side surface 11 are in connection with the first end surface 14 and the second end surface 15. The first end surface 14 can match with front structural members of the electronic device 100. The second end surface 15 can match with rear structural members of the electronic device 100. The front structural members refer to structural members facing a user of the electronic device 100 when the electronic device 100 is in use. The rear structural members refer to structural members facing away from the user of the electronic device 100 when the electronic device 100 is in use. For example, the front structural member is a display screen, and the rear structural member is a rear cover. Each of the first end surface 14 and the second end surface 15 can be a combination of flat surfaces and non-flat surfaces. That is, each of the first end surface 14 and the second end surface 15 may have multiple depressions and protrusions.

In this implementation, the signal trigger 20 is fixed inside the accommodating space 13 defined by the frame 10. The signal trigger 20 may be electrically coupled with internal elements of the electronic device 100, as such, when being triggered by the button 30, the signal trigger 20 can transmit a trigger signal to a functional component. The functional component can act in response to the trigger signal, to control the functional component of the electronic device 100 accordingly. The signal trigger 20 is fixed inside the accommodating space 13 and adjacent to the inner side surface 12. The signal trigger 20 is provided with a switch circuit which can be turned on or off under control (such as through a press operation) of the button post 31, thereby controlling the triggering of an electrical signal.

In an implementation, the button post 31 is abutted against (or, in contact with) the signal trigger 20, such that the signal trigger 20 has an improved sensitivity to the press operation of the button post 31.

In an implementation, there is a distance between the signal trigger 20 and the button post 31, such that a safe distance exists between the button post 31 and the signal trigger 20, and an impact force of the button post 31 on the signal trigger 20 is reduced.

In implementations, the button cap 33, the elastic cushion 32, and the button post 31 are sequentially stacked, and integrally extend through the frame 10. The button cap 33 is adjacent to the outer side surface 11 of the frame 10. The button post 31 is adjacent to the inner side surface 12 of the frame 10. The button post 31 is at least partially located between the outer side surface 11 and the inner side surface 12, which is beneficial for the frame 10 to support and direct the button post 31. The elastic cushion 32 is located between the outer side surface 11 and the inner side surface 12.

During assembling of the button 30, the button post 31 is first penetrated into the frame 10 and one end of the button post 31 is aligned with the signal trigger 20. The elastic cushion 32 is then fixed to the button post 31 at the other end of button post 31 away from the signal trigger 20, such that the button post 31 is securely connected with the elastic cushion 32. And then, the button cap 33 is installed on the frame 10, and the button cap 33 is securely connected with the elastic cushion 32.

In an example, the button post 31 has a length direction which is substantially perpendicular to the inner side surface 12 and the outer side surface 11 of the frame 10, which facilitates the button post 31 to receive a pressing force applied by the button cap 33 and slide in a direction perpendicular to the inner side surface 12 and the outer side surface 11 of the frame 10, such that the sliding force of the button post 31 is focused on the signal trigger 20.

The elastic cushion 32 is substantially perpendicular to the length direction of the button post 31. The elastic cushion 32 is attached to an end surface of the button post 31 at one surface of the elastic cushion 32 which has a relatively large area. A surface of the button cap 33 close to the signal trigger 20 is attached to the other surface of the elastic cushion 32 which has a relatively large area. The button cap 33 completely covers the elastic cushion 32 to ensure effective contact between the button cap 33 and the elastic cushion 32.

The button cap 33 is in a plate shape. The button cap 33 is substantially perpendicular to the length direction of the button post 31. A surface of the button cap 33 away from the button post 31 has an area larger than the end surface of the button post 31, which facilitates the button cap 33 to receive pressing force and transfer the pressing force to the button post 31.

In an example, the button cap 33 is a plate in a long strip shape. A length direction of the button cap 33 is substantially parallel to that of the frame 10. The button cap 33 is connected with the elastic cushion 32 at a middle position between two ends of button cap 33. As such, the button cap 33 is aligned with the button post 31, the button cap 33 can transfer the pressing force to the button post 31 effectively, and the button cap 33 can be prevented from being tilted up under action of the pressing force.

In an example, the surface of the button cap 33 away from the button post 31 may protrude relative to the outer side surface 11, such that the button cap 33 is easily to be perceived when the user touches the outer side surface 11 of the frame 10, which facilitates the user to press the button cap 33.

As illustrated in FIG. 3, when a pressing force is applied on the button cap 33 in a direction which is not parallel to the length direction of the button post 31, one end of the button cap 33 will be lifted up, and at this time, one end of the elastic cushion 32 is compressed while the other end of the elastic cushion 32 is stretched. That is, the elastic cushion 32 absorbs an inclined force (i.e., a force which is not parallel to the button post 31) from the button cap 33, prevents the inclined force from being transferred to the button post 31 from the button cap 33, and in turn prevents the button post 31 from tilting. The elastic cushion 32 is connected with the button post 31 and the button cap 33, such that the button cap 33 is spaced apart from the button post 31. The button post 31 can be aligned with and directly face the signal trigger 20 in the length direction of the button post 31. As such, the button post 31 can effectively trigger the signal trigger 20 and can be reset effectively to avoid being stuck.

In an example, the button cap 33 may also be in a disc shape. The geometric center axis of the button cap 33 is aligned with the geometric center axis of the button post 31. Alternatively, the button cap 33 can also be a triangular, polygonal, or other arbitrary shape plate.

In an example, the surface of the button cap 33 away from the button post 31 may be substantially flush with the outer side surface 11 to improve flatness of the exterior structure of the frame 10.

In an example, the surface of the button cap 33 away from the button post 31 can be recessed relative to the outer side surface 11 to prevent the button 30 from being impacted when the electronic device 100 is dropped, so as prevent the button 30 from being damaged.

In an example, an end surface of the button post 31 away from the elastic cushion 32 may protrude relative to the inner side surface 12, which facilitates an abutment (or, contact) between the button post 31 and the signal trigger 20.

In an example, the end surface of the button post 31 away from the elastic cushion 32 may be flush with the inner side surface 12 to ensure the flatness of the interior structure of the frame 10 and improve the utilization rate of the accommodating space 13.

In an example, the end surface of the button post 31 away from the elastic cushion 32 may be recessed relative to the inner side surface 12. When the button post 31 is pressed by the button cap 33, one end of the button post 31 will protrude relative to the inner side surface 12 of the frame 10 to be abutted against (or in contact with) the signal trigger 20.

In an example, one surface of the elastic cushion 32 connected with the button post 31 completely covers the end surface of the button post 31.

In an example, one surface of the elastic cushion 32 connected with the button post 31 partially covers the end surface of the button post 31.

In implementations of the present disclosure, the elastic cushion 32 is made of silicone. The elastic cushion 32 may be bonded with the button post 31 and the button cap 33 via double-sided adhesive.

In an example, the elastic cushion 32 may also be made of metal. The elastic cushion 32 can be fixedly bonded to the button cap 33 and the button post 31 via glue.

In an example, the elastic cushion 32 may also be an elastic foam sheet.

Figure 4:
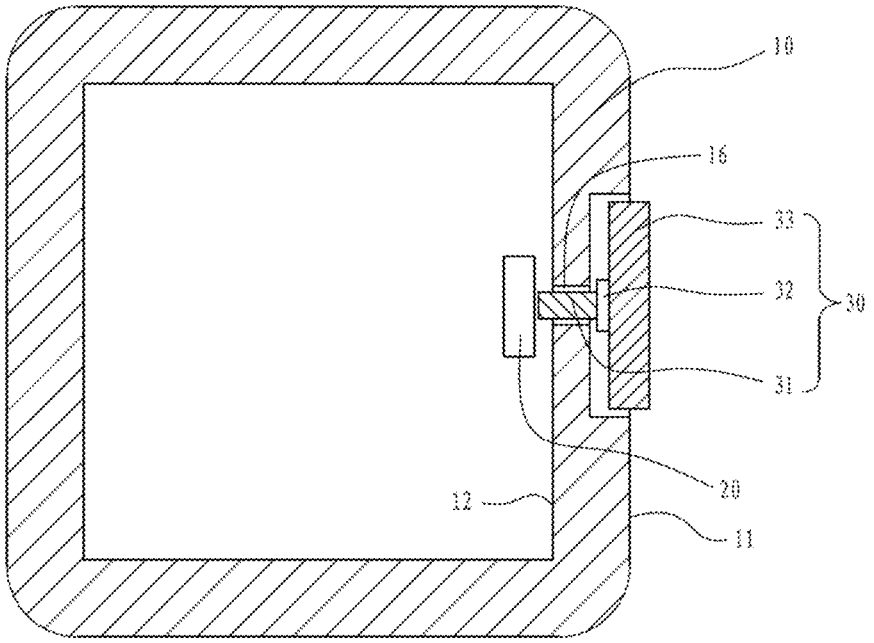
FIG. 4 is a schematic cross-sectional view of an electronic device according to implementations of the present disclosure.

Further, referring to FIG. 4, the frame 10 further defines a button guide hole 16 at a side of the frame 10 close to the signal trigger 20. The button post 31 is inserted into and in clearance fit with the button guide hole 16.

In this implementation, the button guide hole 16 serves as the guide structure for guiding the button 30 when the button 30 is pressed to slide, so as to ensure that the button post 31 is pressed to slide in a direction aligned with the signal trigger 20. The button guide hole 16 extends from the inner side surface 12 toward the outer side surface 11. The button guide hole 16 penetrates the inner side surface 12 so that one end of the button post 31 can pass through the inner side surface 12 of the frame 10 under the pressing action of the button cap 33. The inner circumferential wall of the button guide hole 16 effectively guides the button post 31 to slide relative to the frame 10, so as to ensure that the button post 31 is pressed to slide relative to the signal trigger 20 in a direction which is substantially aligned with the signal trigger 20.

In an example, the length of the button post 31 is greater than the depth of the button guide hole 16, which ensures that one end of the button post 31 can move out of the button guide hole 16.

In an example, an end of the button guide hole 16 away from the inner side surface 12 is substantially adjacent to the outer side surface 11, such that most of the button cap 33 is exposed to the outside of the outer side surface 11, which facilitates receiving the pressing force at the button cap 33.

In an example, one end of the button guide hole 16 away from the inner side surface 12 is substantially located at a middle position between the outer side surface 11 and the inner side surface 12, thus, there is a safety distance between the button guide hole 16 and the outer side surface 11, so as to prevent dust and impurities outside the frame 10 from entering the button guide hole 16 to interfere with sliding of the button post 31 relative to the frame 10.

Figure 5:
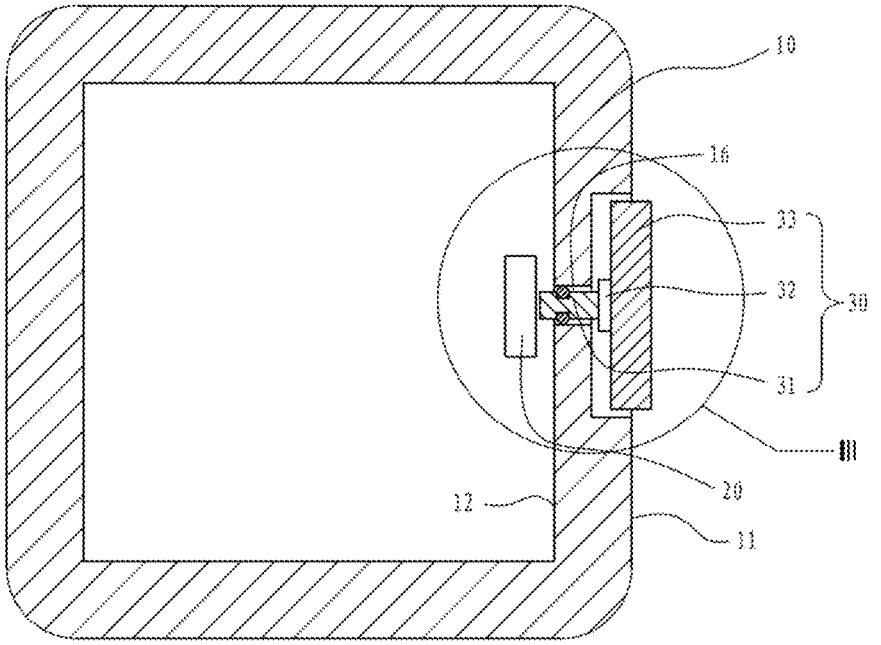
FIG. 5 is a schematic cross-sectional view of an electronic device according to implementations of the present disclosure.
Figure 6:
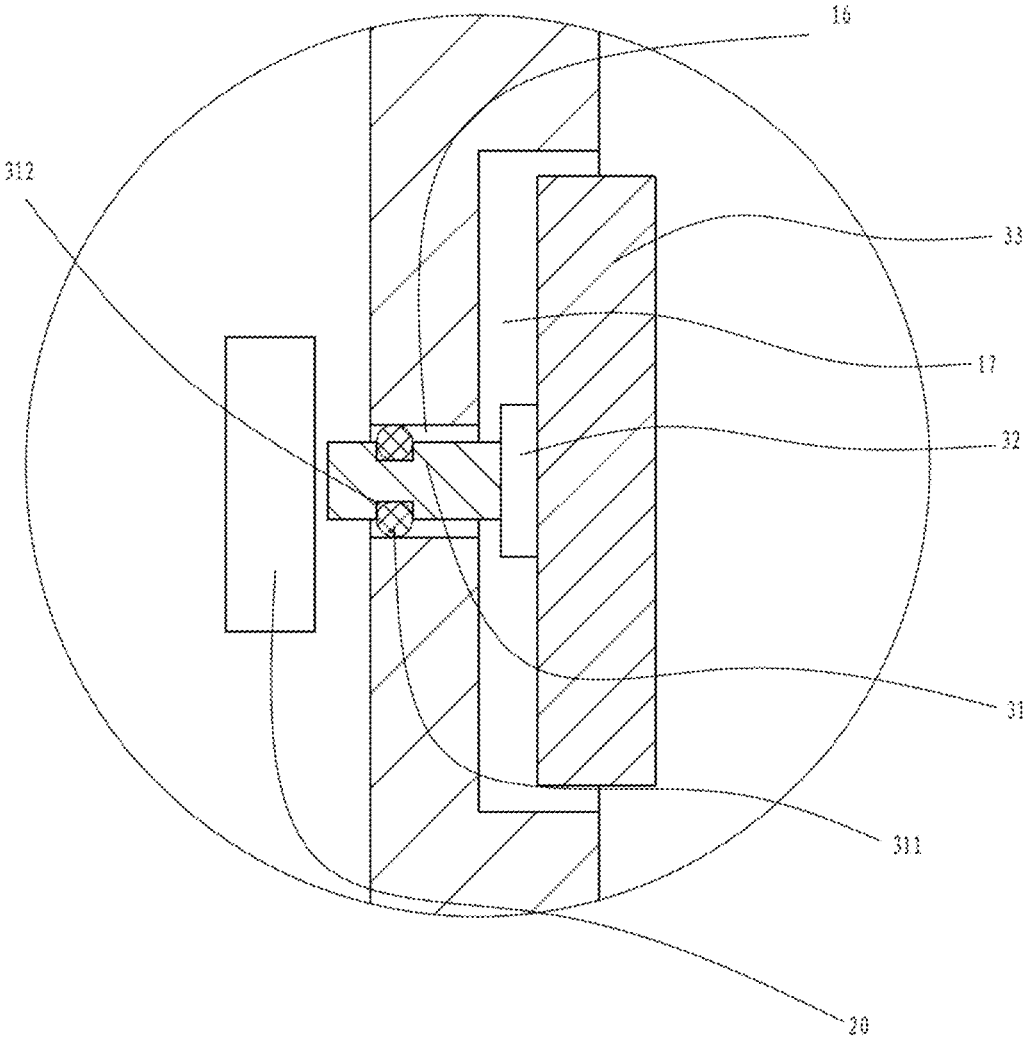
FIG. 6 is a partial enlarged schematic view of structures in circle III of the electronic device illustrated in FIG. 5.

Further, referring to FIG. 5 and FIG. 6, the button post 31 is provided with a sealing ring 311 along circumference at an end of the button post 31 away from the elastic cushion 32. The sealing ring 311 has an outer circumferential wall which is in interference fit with an inner circumferential wall of the button guide hole 16.

In this implementation, the sealing ring 311 is elastically deformable. The sealing ring 311 in a free state has an outer diameter which is greater than an inner diameter of the button guide hole 16. When the sealing ring 311 is inserted into the button guide hole 16 along with the button post 31, the sealing ring 311 will be compressed and deformed under compression action of the inner circumferential wall of the button guide hole 16, so that the sealing ring 311 can be in close contact with the inner circumferential wall of the button guide hole 16 to a large extent, and the sealing ring 311 can seal a gap between the inner circumferential wall of the button guide hole 16 and the outer circumferential wall of the button post 31. The sealing ring 311 can effectively prevent water, dust, and impurities from entering the inside of the frame 10 through the gap between the outer circumferential wall of the button post 31 and the inner circumferential wall of the button guide hole 16. For example, the electronic device 100 is a smart watch, and the electronic device 100 uses the sealing ring 311 to seal the gap between the button post 31 and the inner circumferential wall of the button guide hole 16, so that the electronic device 100 can meet 5 atmospheres (ATMs) waterproof requirement.

In implementations, the button post 31 defines a groove 312 along circumference at one end of the button post 31 away from the elastic cushion 32. The groove 312 has a width which is substantially equal to a difference between the outer diameter and the inner diameter of the sealing ring 311. The sealing ring 311 is sleeved on the button post 31. The sealing ring 311 is partially locked into the groove 312. The sealing ring 311 is detachably connected to the button post 31 to facilitate disassembly and maintenance of the sealing ring 311. When the button 30 is installed to the frame 10, the sealing ring 311 is first sleeved on the button post 31, and then the button post 31 and the sealing ring 311 are integrally inserted into the button guide hole 16.

In an example, the sealing ring 311 and the button post 31 are formed integrally to increase tightness between the sealing ring 311 and the button post 31.

In an example, the sealing ring 311 is made of silicone to improve elastic sealing performance and friction resistance of the sealing ring 311.

In an example, the sealing ring 311 is made of rubber to prolong the service life of the sealing ring 311.

Figure 7:
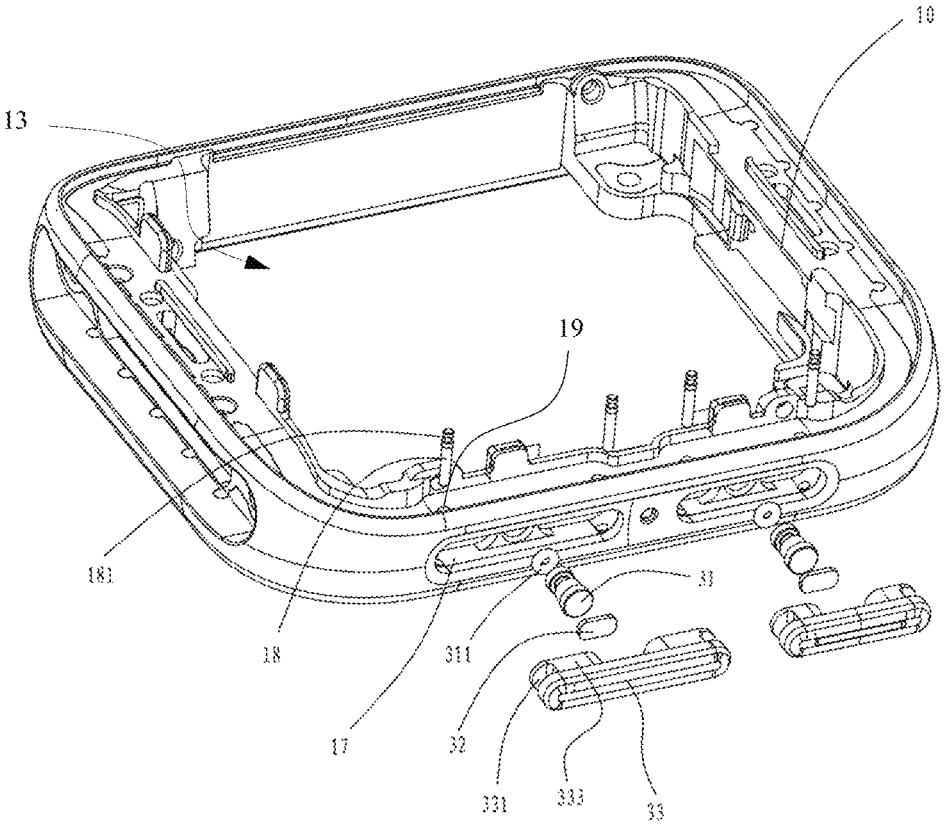
FIG. 7 is a partial exploded schematic view of an electronic device according to implementations of the present disclosure.
Figure 8:
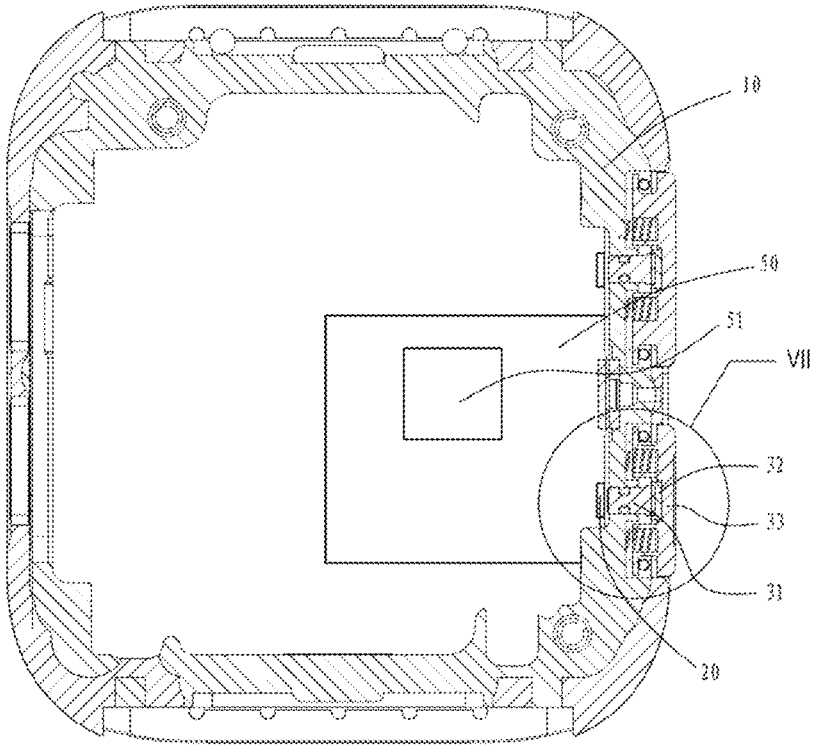
FIG. 8 is a schematic cross-sectional view of an electronic device according to implementations of the present disclosure.
Figure 9:
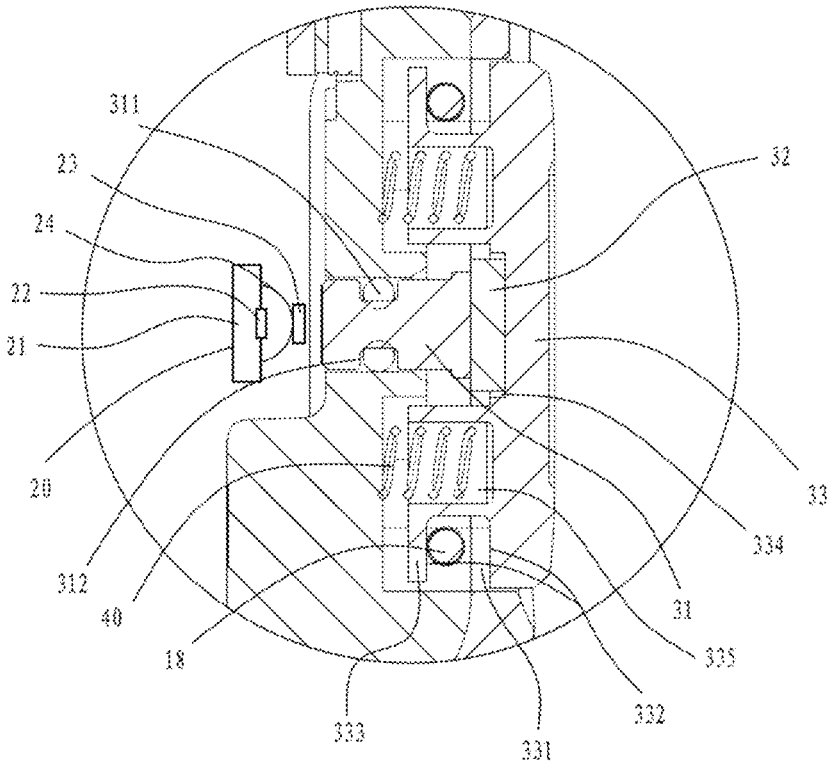
FIG. 9 is an enlarged schematic view of structures in circle VII of the electronic device illustrated in FIG. 8.

Further, referring to FIGS. 7 to 9, the frame 10 defines a button cap hole 17 at one side of the frame 10 away from the signal trigger 20. The button cap hole 17 is in communication with the button guide hole 16. An end of the button cap 33, which is connected with the elastic cushion 32, is at least partially received in the button cap hole 17.

In implementations, the button cap hole 17 extends from the outer side surface 11 toward the inner side surface 12. An inner circumferential wall of the button cap hole 17 is in substantially clearance fit with the outer circumferential wall of the button cap 33, so as to guide the button cap 33 to slide relative to the frame 10 when the button cap 33 is pressed. One end of the button post 31 is inserted into the button cap hole 17 to be in connect with the elastic cushion 32. The elastic cushion 32 is received in the button cap hole 17.

In an example, a part of the button cap 33 is received in the button cap hole 17, and the remaining part is exposed to the outside of the button cap hole 17. When the button cap 33 is pressed to slide relative to the frame 10, the button cap 33 can be completely received in the button cap hole 17. A fitting clearance between the button cap hole 17 and the button cap 33 is greater than that between the button guide hole 16 and the button post 31, so as to prevent the outer circumferential wall of the button cap 33 from being stuck on the inner circumferential wall of the button cap hole 17 when one end of the button cap 33 is lifted up. As such, even if one end of the button cap 33 is lifted up, extension and retraction of button post 31 relative to the frame 10 as well as effective reset of the button cap 33 can be ensured.

In implementations, the frame 10 is provided with a stop pin 18 protruding relative to an inner circumferential wall of the button cap hole 17. The button cap 33 defines a sliding groove 331 at a portion of the button cap 33 which is received in the button cap hole 17. The sliding groove 331 is in slide fit with the stop pin 18 to guide the button cap 33 to slide within a safe range.

In this implementation, the stop pin 18 is substantially perpendicular to the button post 31 of the frame 10. The stop pin 18 is at least partially fixed in the button cap hole 17. The sliding groove 331 has two walls 332 opposite to each other in the length direction of the button post 31. The stop pin 18 is matched with the sliding groove 331, that is, the stop pin 18 penetrates the button cap 33. When the stop pin 18 is abutted against one of the two walls 332 of the sliding groove 331, the button cap 33 cannot slide forward further relative to the frame 10. As such, the button cap 33 is limited to slide within the safe range relative to the frame 10, which is substantially equal to the distance between the two walls 332.

In implementations, the frame 10 defines a pin hole 19 which extends through the inner circumferential wall of the button cap hole 17, a part of the stop pin 18 is inserted into the button cap hole 17 through the pin hole 19 and matches with the sliding groove 331. In other words, the frame 10 defines the pin hole 19 extending from the first end surface 14 to the button cap hole 17. The stop pin 18 penetrates the frame 10 through the pin hole 19. The stop pin 18 is partially received in the button cap hole 17. The sliding groove 331 has an insertion port which faces the first end surface 14. In order to insert the stop pin 18 into the button cap 33, the button cap 33 is first mounted in the button cap hole 17, and then the insertion port of the sliding groove 331 of the button cap 33 is substantially aligned with the pin hole 19. Finally, the stop pin 18 is inserted into the button cap hole 17 through the pin hole 19, as well as inserted into the sliding groove 331 through the insertion port, such that the stop pin 18 is matched with the sliding groove 331. The stop pin 18 defines a disassemble groove 181 at an end thereof. A tool such as a caliper can be inserted into the disassemble groove 181 to disassemble the stop pin 18 from the frame 10, which can facilitate the removal of the button 30 to realize the disassembly and maintenance of the frame 10 and the button 30.

In an example, the pin hole 19 may also extend from the second end surface 15 to the button cap hole 17.

In an example, the sliding groove 331 may also have an insertion port which faces the second end surface 15.

In implementations, the button cap 33 is provided with a protrusion 333 extending toward a bottom of the button cap hole 17 at each of two opposite ends of the button cap 33. The sliding groove 331 is defined in the protrusion 333. The elastic cushion 32 is disposed between the two protrusions 333. The button cap 33 has an increased thickness when being provided with the protrusion 333, such that the sliding groove 331 has an increased length, and thus the distance between the two walls 332 of the sliding groove 331 can meet the safety distance requirement. The frame 10 is provided with two stop pins 18 corresponding to each button 30. The two stop pins 18 penetrate the two protrusions 333 respectively. The elastic cushion 32 is located between the two protrusions 333, such that one end of the button post 31 is located between the two protrusions 333, thereby ensuring that the button cap 33 has a thickness which is sufficient to define the two sliding grooves 331, as well as reducing the overall thickness of the button post 31 and the button cap 33 and effectively utilizing an inner space of the button cap 33. The button cap 33 defines a fixing groove 334 which is located between the two protrusions 333. The elastic cushion 32 is partially fixed in the fixing groove 334 to increase the stability between the elastic cushion 32 and the button cap 33. Due to the compressibility of the elastic cushion 32, the elastic cushion 32 can effectively compensate a tolerance between the button cap 33 and the button post 31, so that the button 30 can work normally within the tolerance. Due to the cushioning performance of the elastic cushion 32, even under extreme conditions, an impact force applied on the button 30 during a collision can be transferred to and absorbed by the elastic cushion 32 without being transferred to the button post 31 to cause an impact to the signal trigger 20, which helps to avoid the failure of the electronic device 100 when the electronic device 100 is dropped, and to prolong the service life of the electronic device 100.

In an example, the elastic cushion 32 is bonded in the fixing groove 334 via glue. The fixing groove 334 can also prevent the glue from overflowing.

In an example, the elastic cushion 32 can also be completely fixed in the fixing groove 334.

Figure 10:
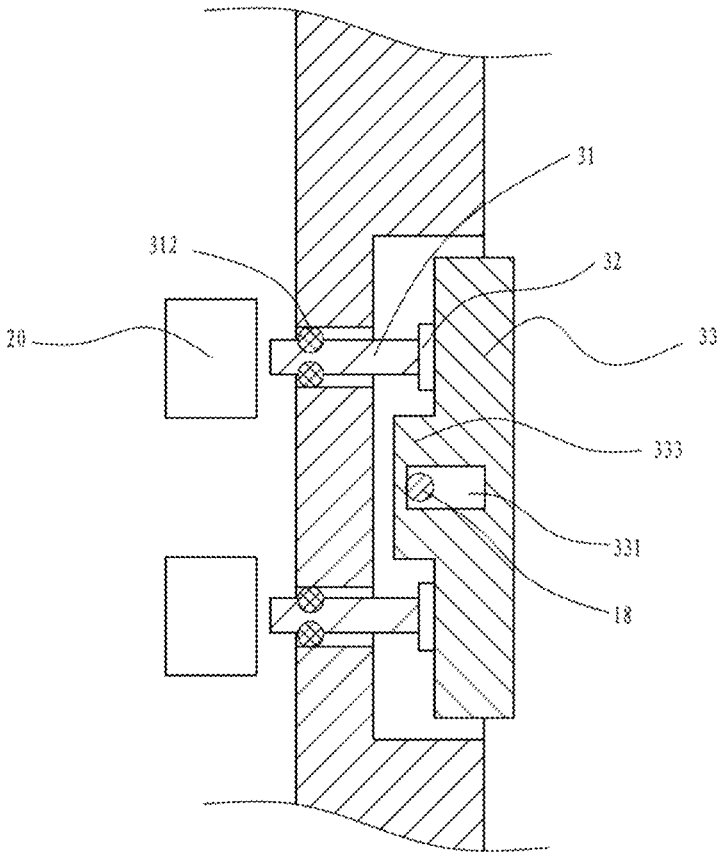
FIG. 10 is a schematic partial cross-sectional view of an electronic device according to an implementation of the present disclosure.

In another implementation, referring to FIG. 10, one button cap 33 can be connected to two button posts 31 via two elastic cushions 32 respectively. One of the two elastic cushions 32 is connected to one end of the button cap 33, and the other of the two elastic cushions 32 is connected to the other end of the button cap 33. The button cap 33 is provided with the protrusion 333 which is located between the two elastic cushions 32. The stop pin 18 of the frame 10 is located between the two elastic cushions 32 to be inserted into the sliding groove 331 of the protrusion 333. The button cap 33 corresponds to the two button posts 31, so that one button cap 33 can trigger two signal triggers 20 to send signals.

In an implementation, referring to FIGS. 7 to 9, the electronic device 100 further includes an elastic member 40 elastically compressed between the button cap 33 and the frame 10.

In this implementation, the protrusion 333 defines an insertion hole 335 at an end surface of the protrusion 333 facing the bottom of the button cap hole 17. One end of the elastic member 40 is inserted into the insertion hole 335. The other end of the elastic member 40 is abutted against the bottom of the button cap hole 17. When the stop pin 18 is abutted against the wall 332 of the sliding groove 331 which is close to the end surface of the protrusion 333, the button cap 33 cannot slide further to be out of the button cap hole 17 under limitation of the stop pin 18, and the elastic member 40 is pre-compressed between the button cap 33 and the frame 10. The elastic member 40 provides an elastic restoring force, which allows the button cap 33 to move in a direction away from the bottom of the button cap hole 17, as such, the button cap 33 can automatically reset under an elastic force of the elastic member 40 after the pressing force is removed.

In an example, the elastic member 40 is a rectangular spring.

In an example, the elastic member 40 is a torsion spring.

In an example, the elastic member 40 is an elastic silicone block or an elastic rubber block.

In an example, the electronic device 100 further includes a mainboard 50 fixed inside the frame 10. The signal trigger 20 is disposed on the mainboard 50.

In implementations of the present disclosure, the mainboard 50 is fixed inside the accommodating space 13. The signal trigger 20 is disposed on an edge of the mainboard 50 adjacent to the inner side surface 12. A processor 51 is disposed on the mainboard 50. The signal trigger 20 is electrically coupled with the processor 51 to send an electrical signal to the processor 51. The processor 51 converts the electrical signal of the signal trigger 20 into various control instructions, and sends the control instructions to functional components of the electronic device 100, so as to control operations of the functional components of the electronic device 100 through the button 30.

In implementations, the signal trigger 20 includes a trigger base 21, a stationary contact 22 disposed on the trigger base 21, a movable contact 23 opposite to the stationary contact 22, and a resilient member 24 disposed between the stationary contact 22 and the movable contact 23. One end of the button post 31 away from the elastic cushion 32 is operable to be abutted against the movable contact 23. The trigger base 21 is fixed on a substrate of the mainboard 50. The stationary contact 22 and the movable contact 23 is substantially aligned with the end of the button post 31 away from the elastic cushion 32, such that the button post 31 can slide to press the movable contact 23 to be in contact with the stationary contact 22. When the movable contact 23 contacts the stationary contact 22, a logic circuit of the signal trigger 20 is turned off or turned on to generate an electric signal.

In an example, the resilient member 24 is a metal resilient sheet. The resilient member 24 is insulated from the movable contact 23 via an insulating member, and ensures that the movable contact 23 can be automatically reset after contacting with the stationary contact 22.

In an example, the button post 31 and the movable contact 23 is spaced apart from each other.

In an example, the button post 31 is abutted against the movable contact 23.

In an example, the signal trigger 20 is a pressure sensor. The signal trigger 20 is provided with a pressure sensing sheet to receive a pressing force applied by the button post 31, so as to trigger an electric signal.

Figure 11:
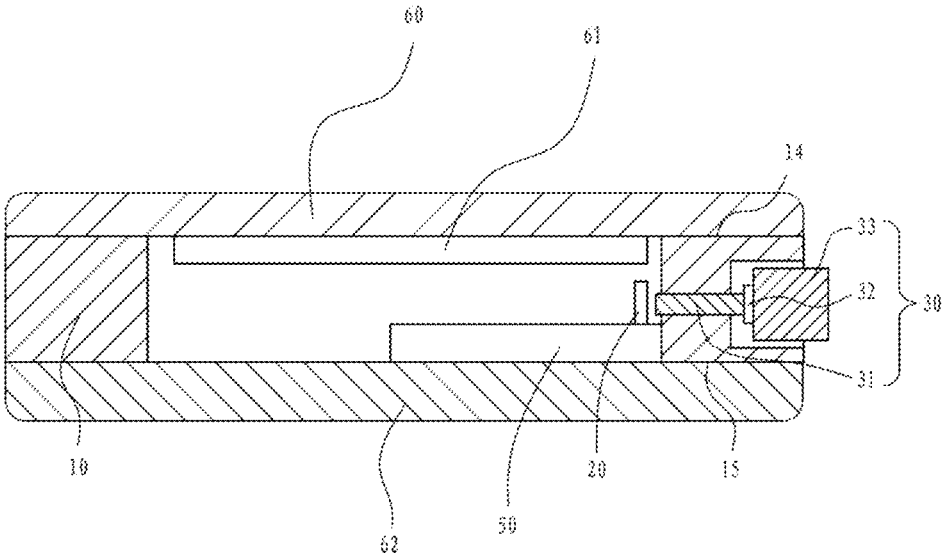
FIG. 11 is a schematic cross-sectional view of the electronic device according to implementations of the present disclosure.

In an example, referring to FIG. 11, the electronic device 100 further includes a transparent cover plate 60 covered on the frame 10 and a display screen 61 attached to the transparent cover plate 60 and sandwiched between the transparent cover plate 60 and the frame 10. The electronic device 100 further includes a rear plate 62 covered on a side of the frame 10 away from the transparent cover plate 60.

In this implementation, the transparent cover plate 60 is covered on the first end surface 14 of the frame 10 and the rear plate 62 is covered on the second end surface 15 of the frame 10. The transparent cover plate 60 is hermetically connected to the frame 10 and the rear plate 62 is hermetically connected to the frame 10, so as to meet the waterproof requirement of the electronic device 100. The display screen 61 is electrically coupled to the mainboard 50 to receive a control signal from the processor 51, so that the display screen 61 can display images.

Figure 12:
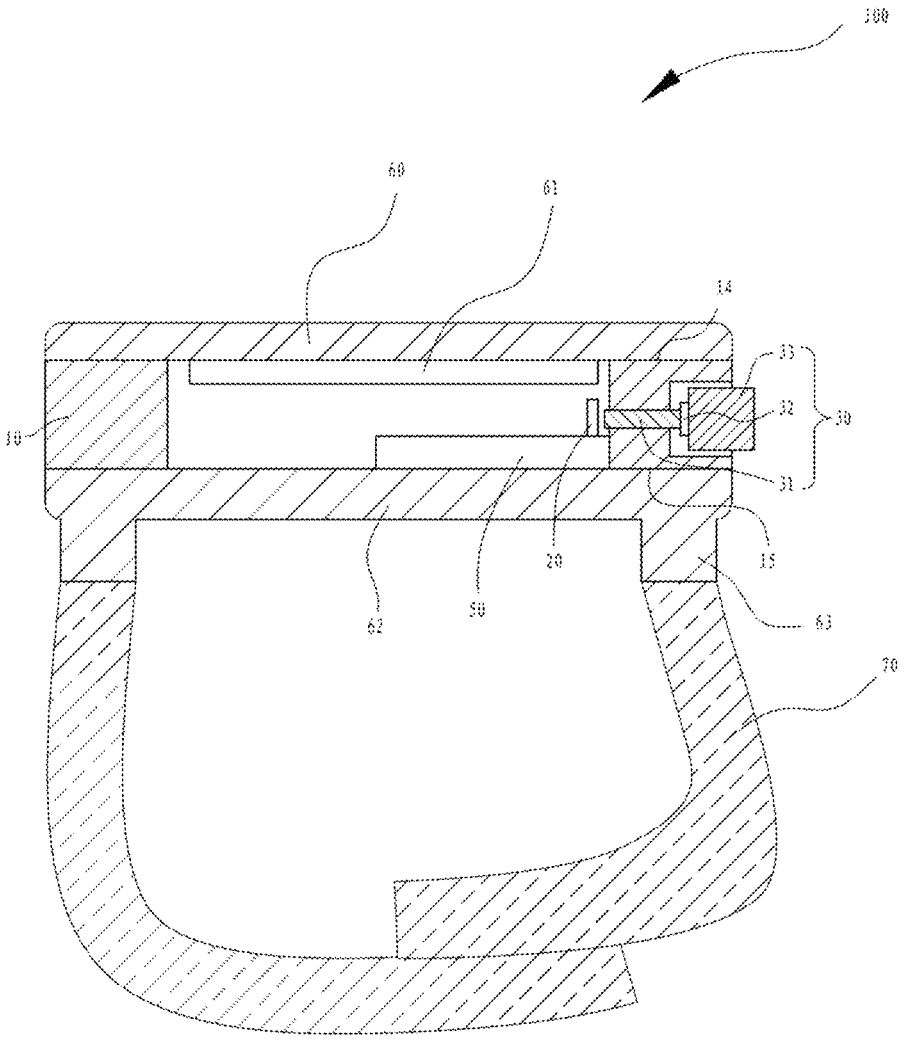
FIG. 12 is a schematic cross-sectional view of an electronic device according to implementations of the present disclosure.

In an implementation, referring to FIG. 12, the electronic device 100 further includes a wearable accessory 70 which is detachably connected to the rear plate 62. The rear plate 62 has a connecting portion 63. The wearable accessory 70 is a watch strap. Ends of the wearable accessory 70 are detachably connected to the connecting portion 63 of the rear plate 62. The electronic device 100 is a smart watch. The frame 10 has four sides of approximately the same length. The frame 10 is provided with multiple buttons 30 along circumference. The electronic device 100 can be operated through the multiple buttons 30.

In an example, the electronic device 100 may also be a smart wristband. The wearable accessory 70 is a wrist strap.

Figure 13:
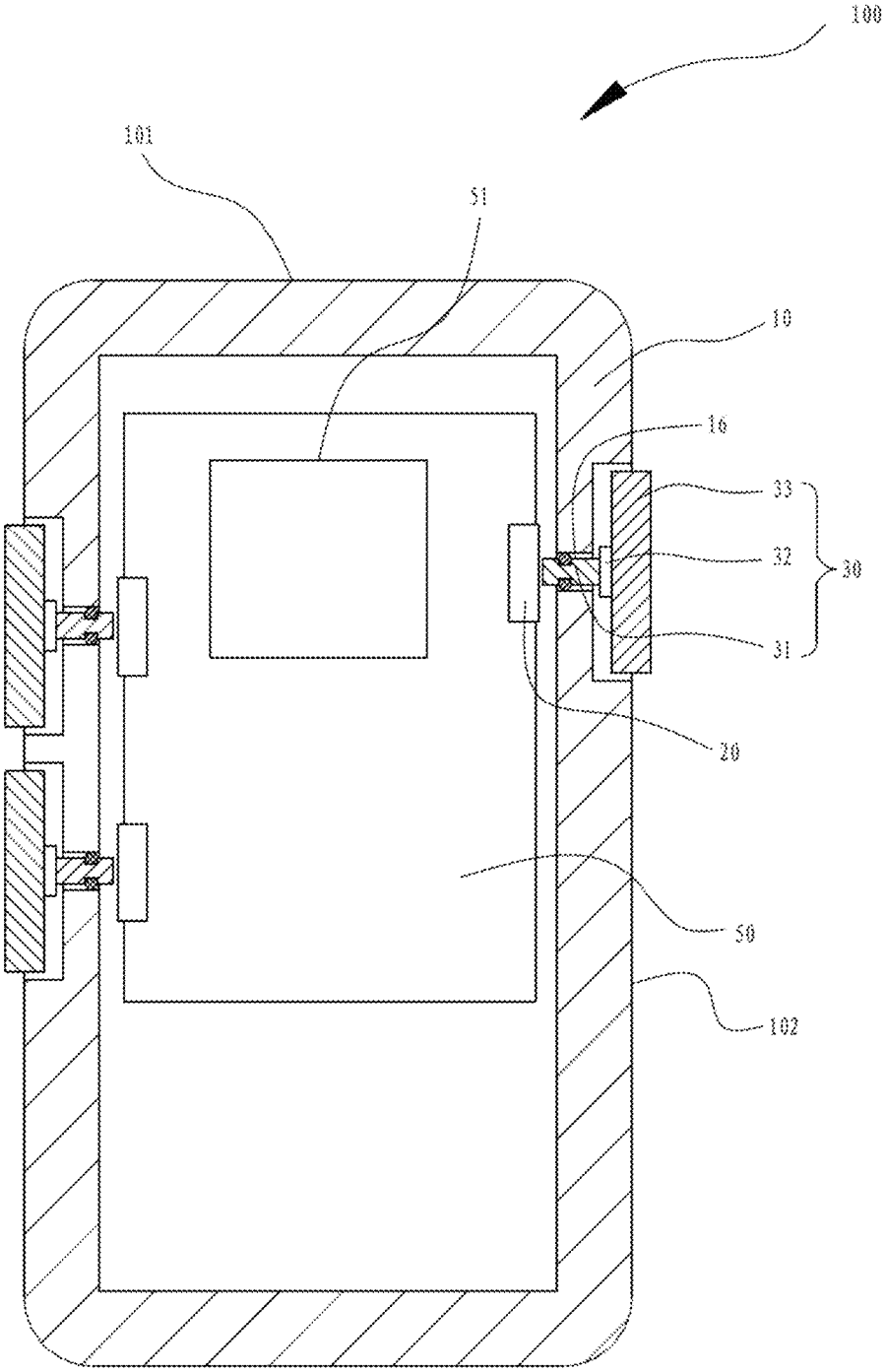
FIG. 13 is a schematic cross-sectional view of an electronic device according to an implementation of the present disclosure.

In another implementation, as illustrated in FIG. 13, the electronic device 100 is a mobile phone. The frame 10 has two relatively short sides 101 and two relatively long sides 102. The button 30 penetrates the long side 102.

In an example, the buttons 30 penetrate the two long sides of the electronic device 100.

In an example, two buttons 30 penetrate the long side 102 of the electronic device 100, and the two buttons 30 may include a volume up key and a volume down key.

In an example, one button 30 penetrates the long side 102 of the electronic device 100. The button 30 can be a screen wake-up key, which can also be operated to turn on/off the mobile phone.

In an example, the button 30 can also penetrate the short side 101 of the frame 10.

Figure 14:
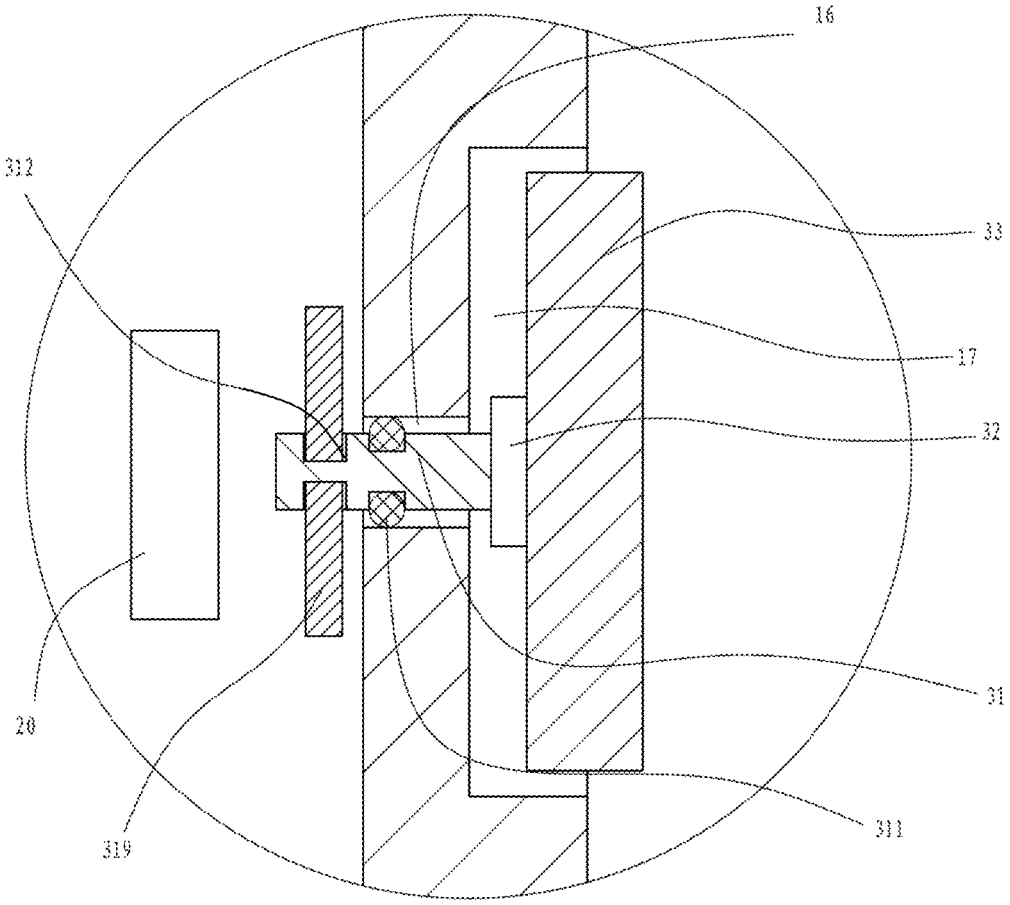
FIG. 14 is a partial enlarged schematic view of an electronic device according to an implementation of the present disclosure.

In another implementation, referring to FIG. 14, the button post 31 is provided with a stop plate 319 along circumference at an end of the button post 31 close to the signal trigger 20. The stop plate 319 has an outer diameter greater than an inner diameter of the button guide hole 16, and the stop plate 319 limits the button post 31 from leaving the frame 10. The stop plate 319 is fixed to the end of the button post 31 close to the signal trigger 20 to prevent the button post 31 from leaving the frame 10 through the button guide hole 16. In a case that the stop plate 319 is fixed to the end of the button post 31, there is high requirement on the structural strength of the end of the button post 31, and moreover, it is difficult to engage the stop plate 319 in an engaging groove 312*a* which is defined at the end of the button post 31, increasing the difficulty in installation. Therefore, in view of above, with aid of the stop pin 18, which is inserted into the sliding groove 331 of the button cap 33, it is possible to avoid installing additional structural components on the button post 31, therefore, the assembly process of the button 30 assembly is simplified, and the use requirements can be satisfied.

Figure 15:
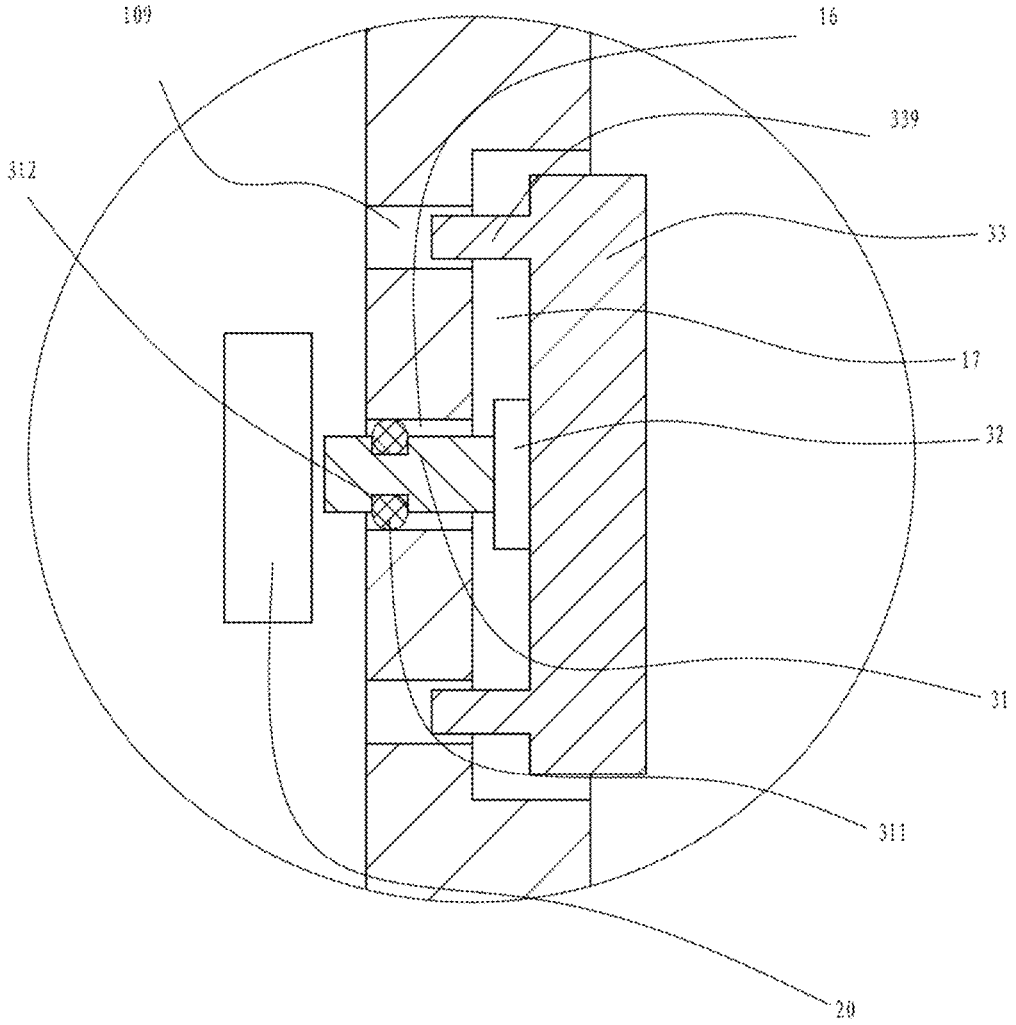
FIG. 15 is a partial enlarged schematic view of an electronic device according to an implementation of the present disclosure.

In an example, referring to FIG. 15, the button cap 33 is provided with two guide posts 339 at two opposite ends of the button cap 33 close to the signal trigger 20. The frame 10 defines two guide holes 109 which are in clearance fit with the two guide posts 339. The elastic cushion 32 is located between the two guide posts 339. The guide post 339 matches with the guide hole 109, such that the two ends of the button cap 33 can be slidably guided effectively, which prevents the button cap 33 from being lifted up to a large extent and ensures the normal operation of the button 30.

Figure 16:
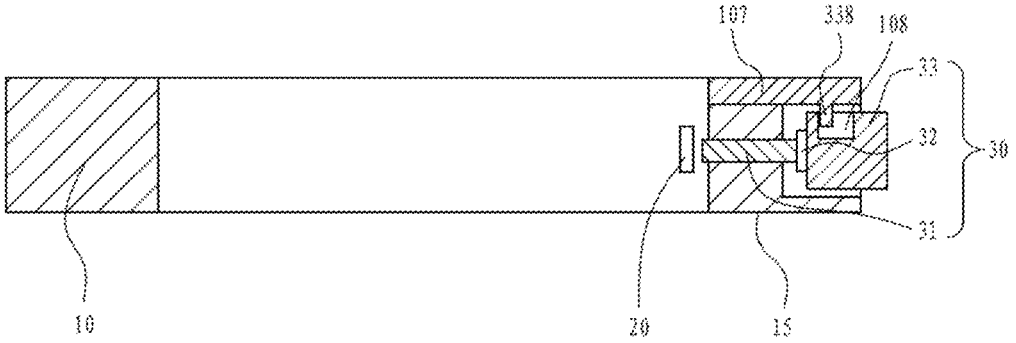
FIG. 16 is a schematic partial cross-sectional view of an electronic device according to an implementation of the present disclosure.

In another implementation, referring to FIG. 16, the frame 10 is provided with a stop protrusion 338. The button cap 33 defines a limiting groove 108 at an outer circumferential wall of the button cap 33 and the limiting groove 108 is in slide fit with the stop protrusion 338. The limiting groove 108 cooperates with the stop protrusion 338 to guide the button cap 33 to slide within a safe range. The electronic device 100 includes a cover 107 covered on the frame 10. The button cap hole 17 and the limiting groove 108 are located between the cover 107 and the frame 10. When the button 30 is assembled in the frame 10, first, the button post 31, the elastic cushion 32, and button cap 33 are installed in the frame 10 in sequence, and then the cover 107 is covered on the frame 10 to allow the stop protrusion 338 of the frame 10 to be inserted in the limiting groove 108 between the frame 10 and the cover 107, so as to prevent the button 30 from detaching from the frame 10.

In the electronic device 100 according to implementations of the present disclosure, the elastic cushion 32 is connected between the button post 31 and the button cap 33, and the button cap 33 can move relative to the button post 31 due to elastic deformation performance of the elastic cushion 32, such that one end of the button 30 is avoided from being stuck if the other end is lifted up, as such, failure of the button 30 is avoided, effective operation performance of button 30 is ensured, and the service life of the button 30 is prolonged.

While the present disclosure has been described in detail above with reference to the exemplary implementations, the scope of the present disclosure is not limited thereto. As will occur to those skilled in the art, the present disclosure is susceptible to various modifications and changes without departing from the spirit and principle of the present disclosure. Therefore, the scope of the present disclosure should be determined by the scope of the claims.

What is claimed is:

1. An electronic device, comprising a frame, a signal trigger fixed inside the frame, and a button penetrating the frame, wherein:

the button comprises a button post, an elastic cushion, and a button cap;

the button post penetrates the frame and is adjacent to the signal trigger;

the elastic cushion is directly connected and fixed with the button post at an end of the button post away from the signal trigger;

the button cap is fixedly connected to a side of the elastic cushion away from the button post and the elastic cushion is sandwiched between the button post and the button cap; and an orthographic projection of the elastic cushion on the button cap has an area greater than an orthographic projection of the button post on the button cap.

2. The electronic device of claim 1, wherein the frame further defines a button guide hole at a side of the frame close to the signal trigger, the button post is inserted into and in clearance fit with the button guide hole.

3. The electronic device of claim 2, wherein:

the button post is provided with a sealing ring along a circumference at an end of the button post away from the elastic cushion, and the sealing ring has an outer circumferential wall which is in interference fit with an inner circumferential wall of the button guide hole.

4. The electronic device of claim 2, wherein:

the frame defines a button cap hole at a side of the frame away from the signal trigger, the button cap hole is in communication with the button guide hole; and an end of the button cap, which is connected with the elastic cushion, is at least partially received in the button cap hole.

5. The electronic device of claim 4, wherein:

the frame is provided with a stop pin protruding relative to an inner circumferential wall of the button cap hole; and the button cap defines a sliding groove at a portion of the button cap which is received in the button cap hole, wherein the sliding groove is movable relative to and limited by the stop pin which extends through the sliding groove, so as to guide the button cap to slide within a safe range.

6. The electronic device of claim 5, wherein the frame defines a pin hole which extends through the inner circumferential wall of the button cap hole, a part of the stop pin is inserted into the button cap hole through the pin hole and matches with the sliding groove.

7. The electronic device of claim 5, wherein:

the button cap is provided with a protrusion extending toward a bottom of the button cap hole at each of two opposite ends of the button cap;

the sliding groove is defined in the protrusion; and the elastic cushion is disposed between two protrusions.

8. The electronic device of claim 2, wherein the button post is provided with a stop plate along a circumference at an end of the button post close to the signal trigger, wherein the stop plate has an outer diameter greater than an inner diameter of the button guide hole, and the stop plate limits the button post from leaving the frame.

9. The electronic device of claim 1, further comprising an elastic member elastically compressed between the button cap and the frame.

10. The electronic device of claim 1, wherein the button cap defines a fixing groove, and the elastic cushion is partially fixed in the fixing groove.

11. The electronic device of claim 10, further comprising a wearable accessory which is detachably connected to a rear plate.

12. The electronic device of claim 1, wherein:

the button cap is provided with two guide posts at two opposite ends of the button cap close to the signal trigger;

the frame defines two guide holes which are in clearance fit with the two guide posts; and the elastic cushion is located between the two guide posts.

13. The electronic device of claim 1, wherein:

the frame is provided with a stop protrusion;

the button cap defines a limiting groove at an outer circumferential wall of the button cap, and the limiting groove is in slide fit with the stop protrusion; and the limiting groove cooperates with the stop protrusion to guide the button cap to slide within a safe range.

14. The electronic device of claim 1, wherein the button cap is operable to apply a force to the button post to allow the button post to move to be in contact with the signal trigger.

15. The electronic device of claim 1, wherein an end of the button post close to the signal trigger is received in the frame when the button is in a free state, and is operable to move to be in contact with the signal trigger.

16. The electronic device of claim 1, wherein an end of the button post close to the signal trigger extends through an inner side surface of the frame close to the signal trigger, and is operable to move to be in contact with the signal trigger.

17. An electronic device, comprising a frame, a signal trigger fixed inside the frame, a button attached to the frame, a transparent cover plate covered on the frame, and a display screen sandwiched between the transparent cover plate and the frame, wherein:

the button comprises a button post, an elastic cushion, and a button cap connected in sequence;

the button post penetrates the frame and is adjacent to the signal trigger;

the elastic cushion is directly connected and fixed with the button post at an end of the button post away from the signal trigger;

the button cap is movable relative to the button post and the elastic cushion is sandwiched between the button post and the button cap; and an orthographic projection of the elastic cushion on the button cap has an area greater than an orthographic projection of the button post on the button cap.

18. The electronic device of claim 17, wherein:

the frame defines a button guide hole at a side of the frame close to the signal trigger, the button post extends through and is movable relative to the button guide hole;

the frame further defines a button cap hole at a side of the frame away from the signal trigger, the button cap hole is in communication with the button guide hole; and an end of the button cap, which is connected with the elastic cushion, is at least partially received in the button cap hole.

19. The electronic device of claim 17, wherein the button cap is operable to apply a force on the button post to allow the button post to be in contact with the signal trigger.

20. The electronic device of claim 17, wherein the button cap is operable to be inclined relative to the button post.

* * * * *